US006409030B1

(12) United States Patent
Schlemper

(10) Patent No.: US 6,409,030 B1
(45) Date of Patent: Jun. 25, 2002

(54) ADAPTER FOR MOUNTING A MODULE ON A CARRIER BAR OF A TEXTILE MACHINE

(75) Inventor: Klaus Schlemper, Solingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 09/603,766

(22) Filed: Jun. 26, 2000

(30) Foreign Application Priority Data

Jun. 24, 1999 (DE) ..... 199 28 885

(51) Int. Cl.[7] ..... D05C 15/10
(52) U.S. Cl. ..... 211/70.6; 112/80.45
(58) Field of Search ..... 211/70.6; 112/80.4, 112/80.45

(56) References Cited

U.S. PATENT DOCUMENTS 4,637,329 A * 1/1987 Czelusniak, Jr. ..... 112/80.45
6,116,173 A * 9/2000 Beyer ..... 112/80.45
6,192,814 B1 * 2/2001 Beverly ..... 112/80.55

* cited by examiner

*Primary Examiner*—Daniel P. Stodola
*Assistant Examiner*—Erica B. Harris
(74) *Attorney, Agent, or Firm*—Venable; Gabor J. Kelemen

(57) ABSTRACT

An assembly for a textile machine includes a carrier bar for attachment to the textile machine; a module base body carrying a plurality of tools and having a mounting; and an adapter received in the mounting and including holding and orienting arrangements for holding the module base body and for orienting the module base body relative to the carrier bar. The adapter is suitable to conform variously configured module base bodies to variously configured carrier bars.

21 Claims, 13 Drawing Sheets

ADAPTER FOR MOUNTING A MODULE ON A CARRIER BAR OF A TEXTILE MACHINE

CROSS REFERENCE TO RELATED APPLICATION

This application claims the priority of German Application No. 199 28 885.2 filed Jun. 24, 1999, which is incorporated herein by reference.

BACKGROUND OF THE INVENTION

This invention relates to a module, particularly a tufting module which has a module base body carrying a plurality of tools and which is to be mounted on a carrier bar of a textile machine.

Textile machines are conventionally provided with carrier bar assemblies which include a carrier bar for holding modules with module base bodies each carrying a number of tufting, knitting or Raschel tools. In addition to needles, the base body may support velour grippers, reed fingers, loop grippers and knives.

German Utility Model No. 295 20 281 discloses a carrier bar system in which the carrier bar has an essentially planar contact face for the cooperating contact faces of base bodies for tufting modules. According to an embodiment, a groove is provided in the planar contact face of the carrier bar, and at each clamping location for a tufting module an extension projects laterally in the direction of the tools. The base bodies of the tufting modules are accordingly provided with a T-shaped rib which fits into the groove and positions the tufting module. A securing screw is provided for tightening the tufting module to the carrier bar.

The tufting modules provided with T-shaped ribs can be used only with carrier bars provided with grooves specifically designed for such ribs.

The above-noted German Utility patent document further discloses an additional embodiment in which the contact face of the carrier bar is provided with a groove which extends through the carrier bar along its length. A strip provided with recesses is inserted into the groove. Each recess has a bottom which approximately covers the contact face of the carrier bar. The regions rising between the recesses form projections beyond the contact face of the carrier bar when the strip is positioned in the groove. The base bodies of the tufting modules have corresponding openings for the projections so that the projections are seated in a form-locking manner on the strip and are oriented by the strip relative to one another.

Such tufting modules can be utilized only in the specifically designed carrier bar/strip combination.

According to yet another embodiment disclosed in the above-identified German Utility Model document, a throughgoing strip is accommodated in the groove. The strip cooperates with a throughgoing groove provided in each module base body. Further, the module base body has at its end oriented away from the strip, a U-shaped recess into which extends an adapter member positioned in a recess of the carrier bar. Again, the base body of the tufting module is designed specially for such a configuration of the carrier bar.

Further, German Patent No. 4,406,412 discloses a carrier bar assembly for holding modules with tufting, knitting or Raschel tools. A fitting member is inserted between the base body of the respective module and the carrier bar. The fitting member has a first flat side oriented towards the carrier bar and a second flat side which is parallel to the first flat side and which is oriented towards the module base body. The module base body which, with one side, contacts the fitting member face-to-face, is pressed against the fitting member and the carrier bar by means of a pressing member contacting the other side of the module base body. As a result, the module base body is clamped between the fitting member and the pressing member. For orienting the module base body, a strip having an elongated contact face is provided at that end of the module base body which is oriented toward the needles.

The modules are not adapted for use for other carrier bars with profiled contact faces.

SUMMARY OF THE INVENTION

It is an object of the invention to provide a module of the above-outlined type which may be used with carrier bars having different configurations.

This object and others to become apparent as the specification progresses, are accomplished by the invention, according to which, briefly stated, an assembly for a textile machine includes a carrier bar for attachment to the textile machine; a module base body carrying a plurality of tools and having a mounting; and an adapter received in the mounting and including holding and orienting arrangements for holding the module base body and for orienting the module base body relative to the carrier bar. The adapter is suitable to conform variously configured module base bodies to variously configured carrier bars The module according to the invention is structured as a standard module which may be adapted by means of suitable adapters to carrier bars having a wide variety of mounting systems, and dependent on the carrier bar system, the appropriate adapter is used. The base body of the module is provided with a mounting for accommodating the replaceable adapter. No firm connection has to be provided between the mounting and the adapter; it suffices if the mounting unequivocally positions the adapter and the module base body relative to one another. The mounting may be formed by a contact face forming part of the base body The adapter may have orienting means for a correct positioning relative to the base body as well as additional orienting means for the correct positioning relative to the carrier bar. Various adapters may have specific orienting means for various carrier bars. The module is then properly positioned on the carrier bar by means of the adapter. Dependent on the embodiment of the adapter the module may be adjusted along one or two axes (that is, it may be adjusted laterally or in height). By means of the position-determining adapter, the standard module may be used not only in various tufting machines with different carrier bar techniques but it is also feasible to reproduce the position of a module individually and independently from the entire module formation in various carrier bar mounting systems in various machines.

The adapter may be secured to the module in a form-fitting manner, for example, by means of profiles having a conical guide, a dovetail guide, a T-shaped guide or similar undercut contours. By means of a certain resilience of the adapter or parts thereof, a snap-in detent effect may be achieved.

If required, other or additional measures may be taken to securely hold the adapter captive on the module. Thus, for example, the adapter may be attached to the module by an adhering or adhesive substance. Further, a frictional securement is feasible by clamping in a recess or by pins which are frictionally seated in openings. As far as manufacture is concerned, a standard module may be provided which fits a specific carrier bar of a specific machine merely by using a specific adapter. The adapters may be irremovably attached to the module. Preferably, however, they are releasably held in a mounting of the module so that the modules may not only be specified by the manufacturer but also, by using different adapters, may be transferred by the user from one machine to another.

Basically, various adapter embodiments are feasible. For example, the adapter may be essentially a component on which no forces are exerted and which merely serves for positioning. In such a case a direct contact between the module base body and the carrier bar exists and thus a direct force transmission between these two components occurs.

In the alternative, the adapter may be an intermediate component so that the clamping and holding forces are transmitted over large areas.

In a further alternative the adapter may be a force-transmitting element positioned between the carrier bar and the base body and thus forms a connecting member between the module and the carrier bar. The mounting formed on the base body cooperates with the adapter preferably in a form-fitting manner. In such a module system, several adapters (that is, an adapter kit), each fitting into the module mounting, belong to a module and each adapter is configured in a carrier bar-specific manner. The adapters, which may be made of metal or plastic, make it possible to provide module base bodies having a simple basic form and even make possible a fit with carrier bar contact faces which have a complex geometry.

DESCRIPTION OF THE PREFERRED EMBODIMENTS

Figure 1:
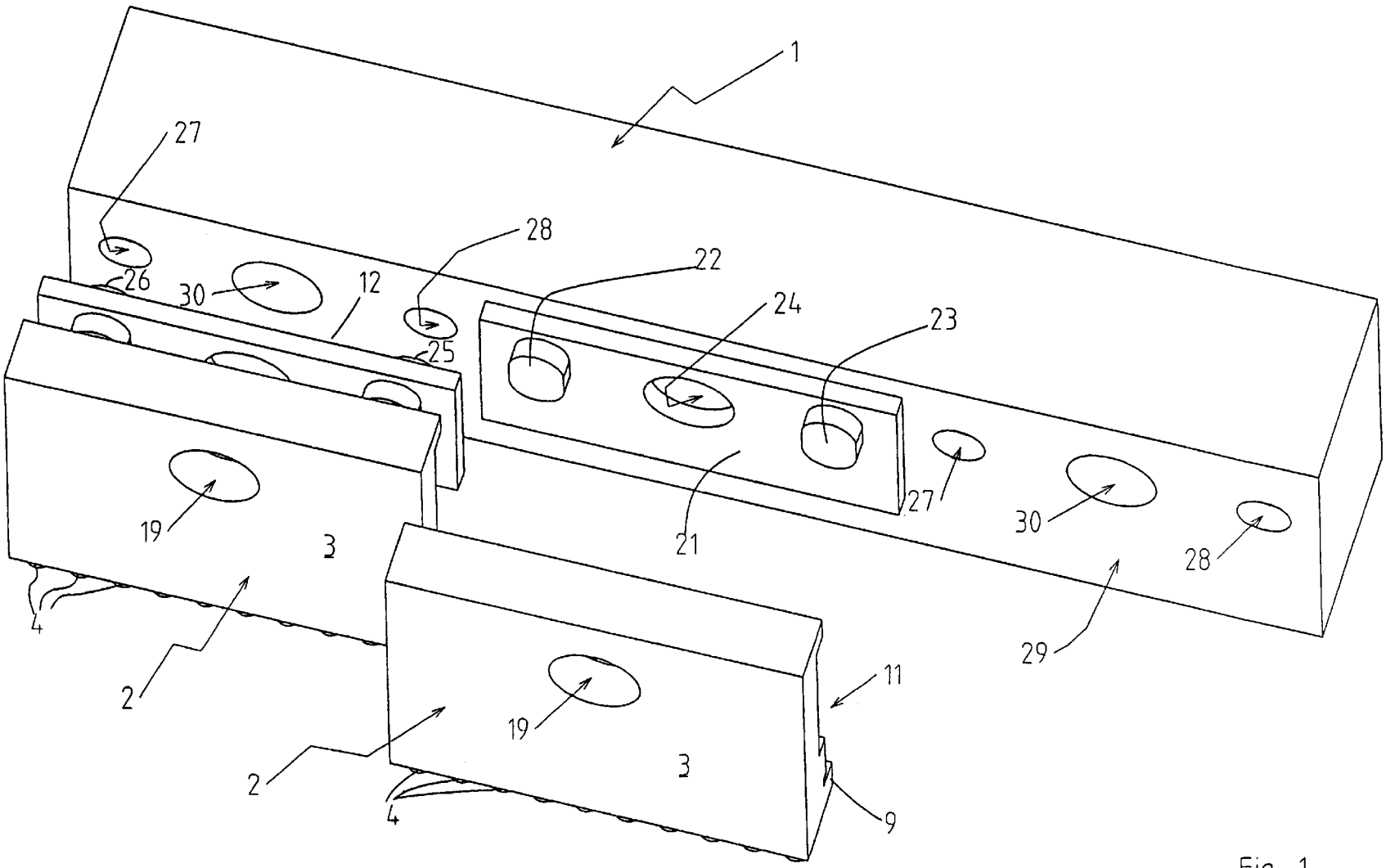
FIG. 1 is an exploded perspective view of a preferred embodiment of the invention, showing a carrier bar with standard tufting modules and adapters.

FIG. 1 shows a carrier bar 1 of a tufting machine on which modules 2 (tufting modules) are serially mounted in an accurate distribution. Each module 2 may carry needles, velour grippers, reed fingers, loop grippers and/or knives, not shown in detail. Each module includes a module base body 3 in or on which the needles, grippers, etc. are mounted. The needles are illustrated only by their short shanks 4.

Figure 4:
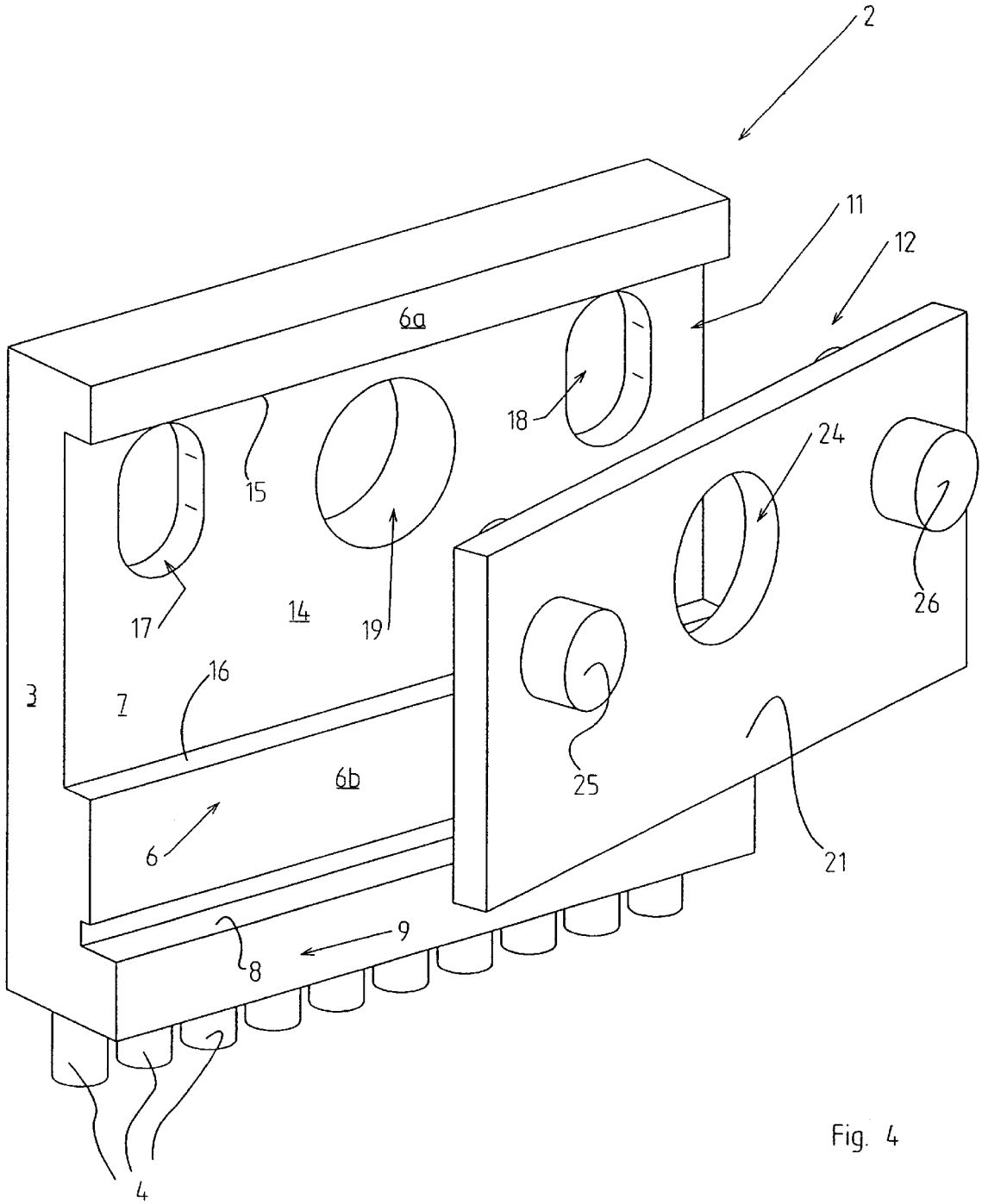
FIG. 4 is an enlarged exploded perspective view of the standard module and adapter according to FIG. 1.

The base body 3 is essentially rectangular and has, as shown in FIG. 4, a substantially planar contact face 6 on its side oriented towards the carrier bar 1. The contact face 6 is subdivided by a shallow and relatively wide groove 7 into two surface regions 6*a* and 6*b*. An orienting or force-transmitting surface 8 is provided which is perpendicular and adjacent to the surface region 6*b* and which forms a part of a rib 9 connected with the base body 3, preferably as a one-piece component thereof.

The groove 7 constitutes a receiver or mounting 11 for an adapter 12 which serves for orienting the module 2 on the carrier bar 1. The mounting 11 has a flat, planar bottom 14 extending parallel to the contact face 6. The bottom 14 is bounded by parallel, planar side walls 15, 16. In the bottom 14 two spaced recesses (blind bores) 17, 18 are formed, and between the blind bores 17, 18, in the bottom 14, the base body 3 is provided with a throughgoing mounting opening 19.

Figure 5:
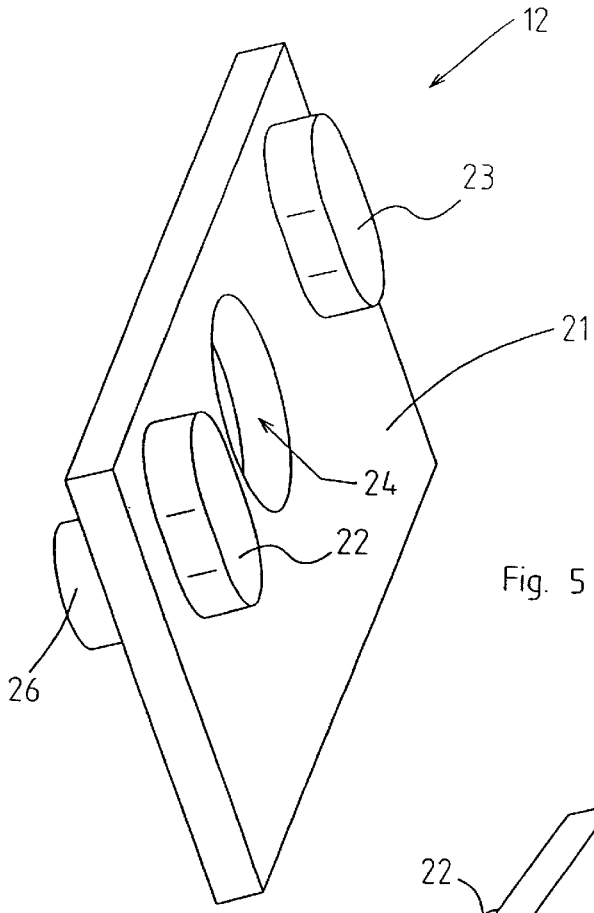
FIGS. 5 and 6 are perspective views, as seen from opposite sides, of the adapter shown in FIG. 1.

The adapter 12 is a plastic or metal component having a plate-shaped portion 21 dimensioned such that it fits with a small play between the side walls 15, 16 and thus essentially fills the mounting 11 of the module base body 3. As shown in FIG. 5, two oval projections 22 and 23, serving as orienting means, rise from the plate-shaped portion 21 and fit into the blind bores 17, 18 of the base body 3. Further, the mounting opening 19 provided in the base body 3 cooperates with an opening 24 which passes through the plate-shaped portion 21 of the adapter 12 and which is in alignment with the mounting opening 19. That planar side of the portion 21 which is oriented towards the carrier bar 1 is situated approximately coplanar with the flat regions 6*a*, 6*b* when the adapter 12 is in its inserted position in the mounting 11.

Figure 6:
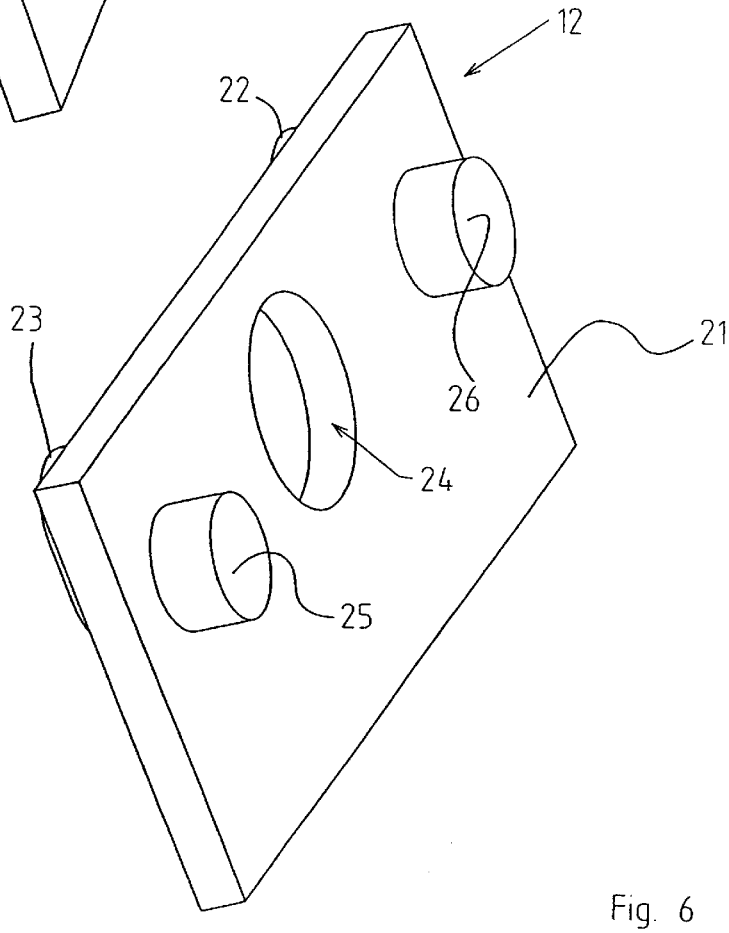

As illustrated in FIG. 6, two further projections 25 and 26 serving as positioning (orienting) means extend outwardly from that planar face of the portion 21 which is oriented toward the carrier bar 1. The projections 25, 26 are adapted to be received by orienting openings 27, 28 (FIG. 1) provided in the carrier bar 1.

The adapter 12 may be, for example, frictionally held in the mounting 11. For this purpose the projections 22, 23 may be, for example, slightly conical to ensure that they are firmly held in the blind bores 17, 18. In the alternative or in addition, the portion 21 may be slightly oversized relative to the distance between the two side walls 15, 16 to fit frictionally therebetween.

As a further alternative, it is feasible, particularly if the adapter 12 is plastic, to secure the same on the base body 3 by means of a snap-in connection. For this purpose the side walls 15, 16 may be provided with a conical, arcuate or similar undercut in which case at the long narrow sides of the plate-shaped portion 21 suitable snap-in detents are provided.

Figure 10:
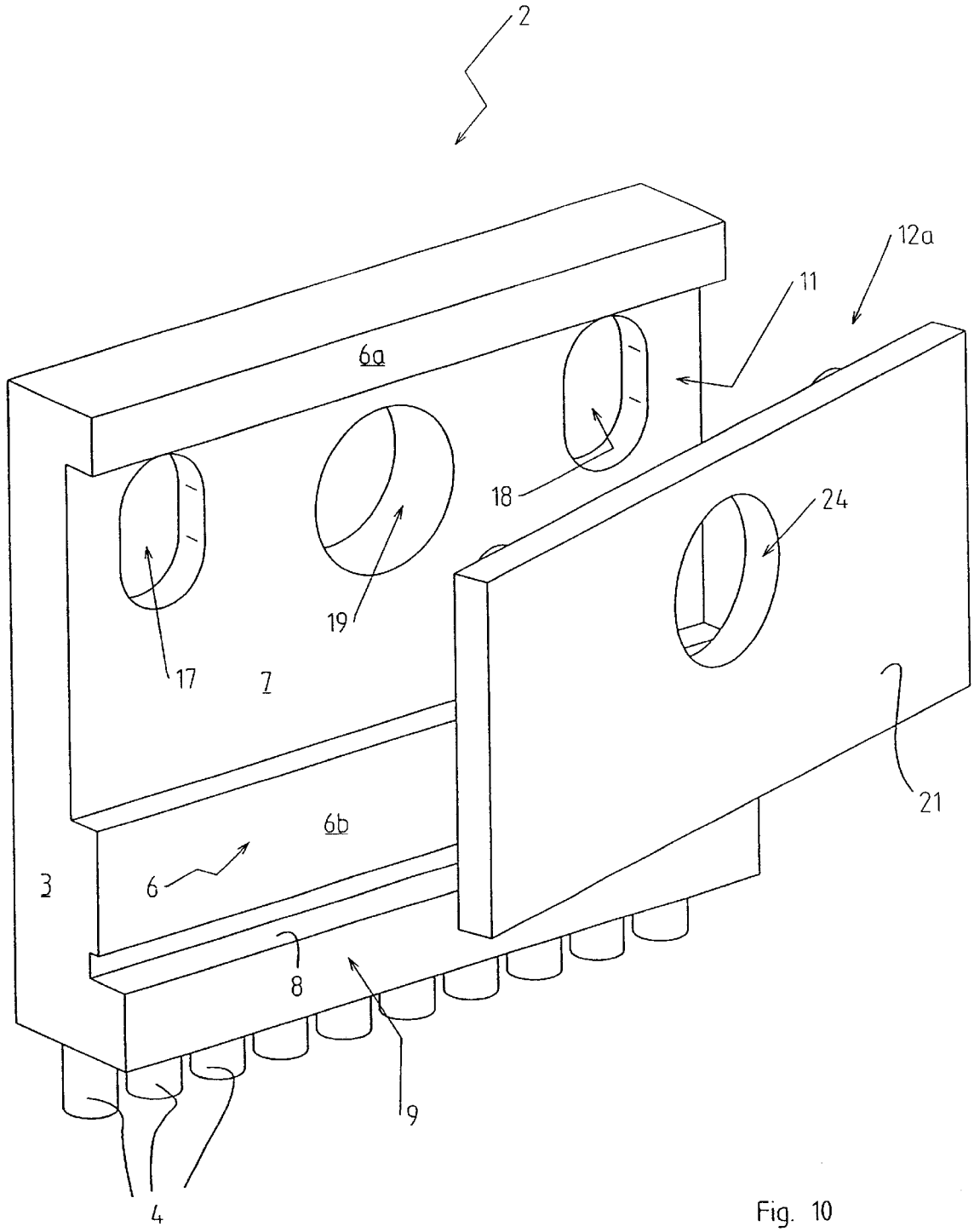
FIG. 10 is an exploded perspective view of the module of FIG. 2 and further showing a modified adapter.
Figure 11:
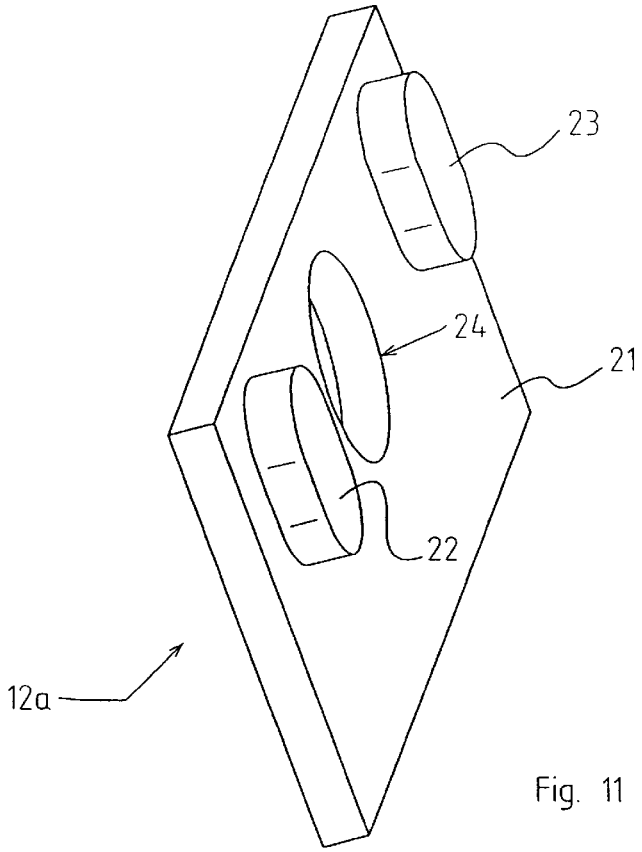
FIGS. 11 and 12 are perspective views, as seen from opposite sides, of the adapter shown in FIG. 10.
Figure 12:
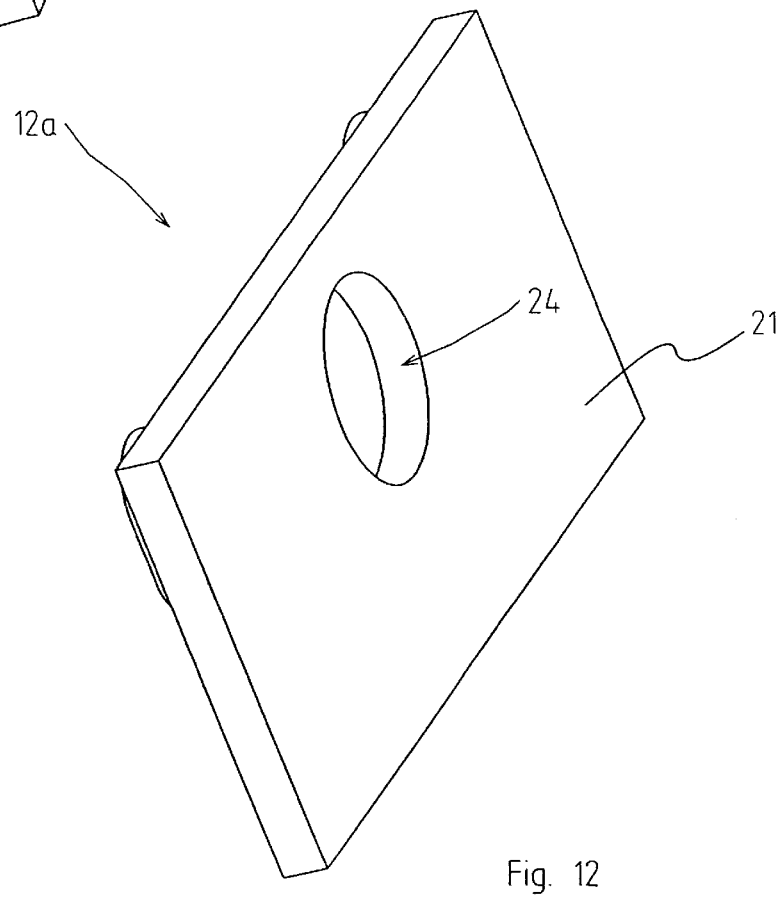

The adapter 12 is replaceable and can be, for example, exchanged for another adapter 12*a* shown in FIGS. 10, 11 and 12. The adapter 12*a* differs from the adapter 12 according to FIG. 4 in that the cylindrical or slightly conical projections 25 and 26 of the adapter 12 are absent. In other respects the adapters 12, 12*a* are structurally identical and fit in an identical, mutually replaceable manner into the mounting 11 of the base body 3. By means of the adapter 12*a* which may be regarded as a standard adapter, the module 2 may be mounted on carrier bars which have a planar contact face for receiving the contact face 6 of the module 2 and have a further planar, narrow contact or orienting surface which extends perpendicularly to the contact face 6 and which serves for transmitting forces between the module and the carrier bar. If the adapter 12*a* is substituted for the adapter 12 of FIG. 4, the same module 2 may be mounted on a carrier bar 1 shown in FIG. 1. The projections 25, 26 engage into the corresponding orienting openings 27, 28 which are provided in an otherwise planar contact face 29 and thus position the module 2 on the carrier bar 1. The contact face 29 is interrupted by securing openings 30 into which securing screws may be threadedly inserted.

Figure 2:
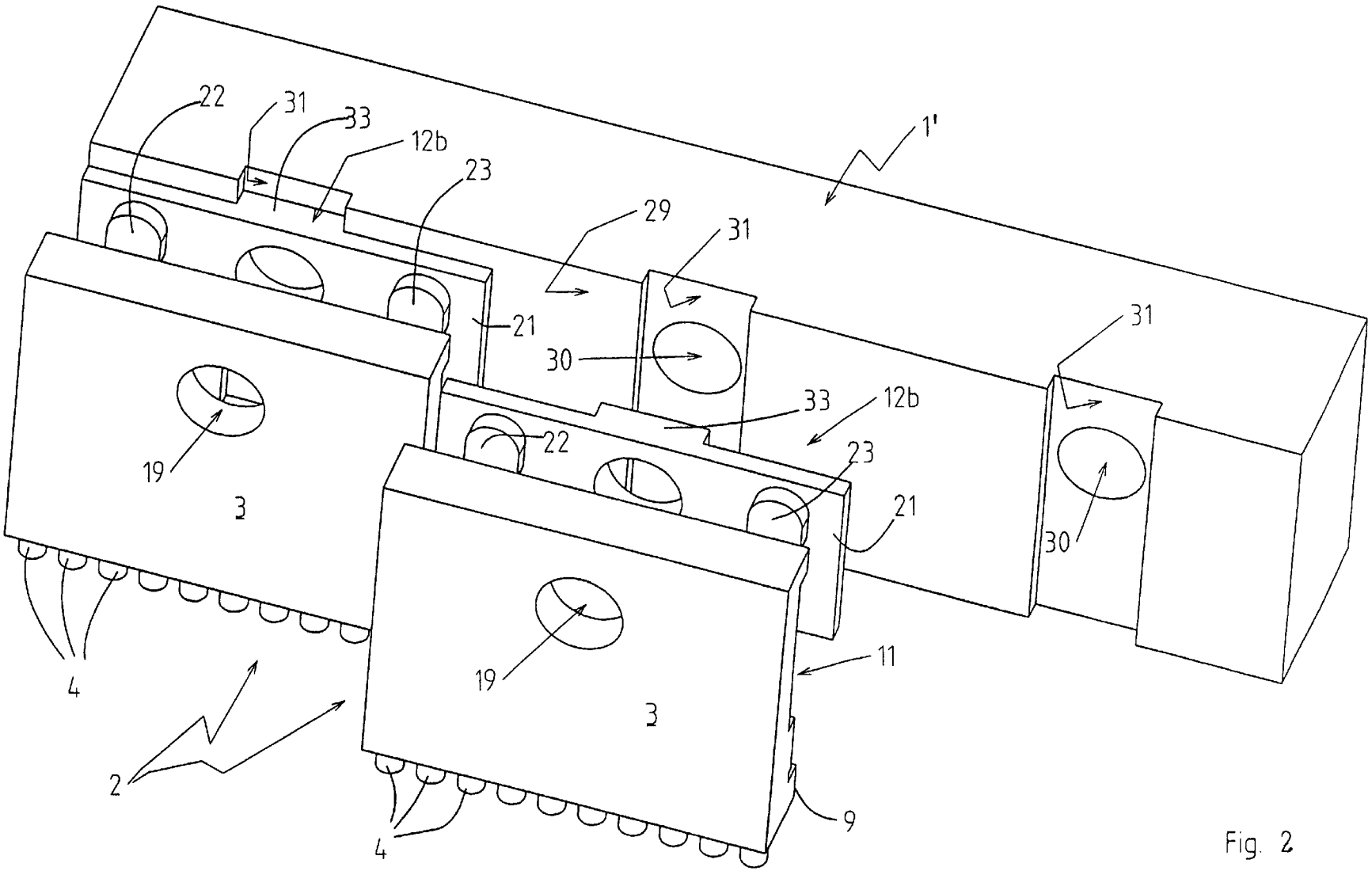
FIGS. 2 and 3 are exploded perspective views, similar to FIG. 1, of two further embodiments of the invention, illustrating carrier bars, modules and adapters.
Figure 7:
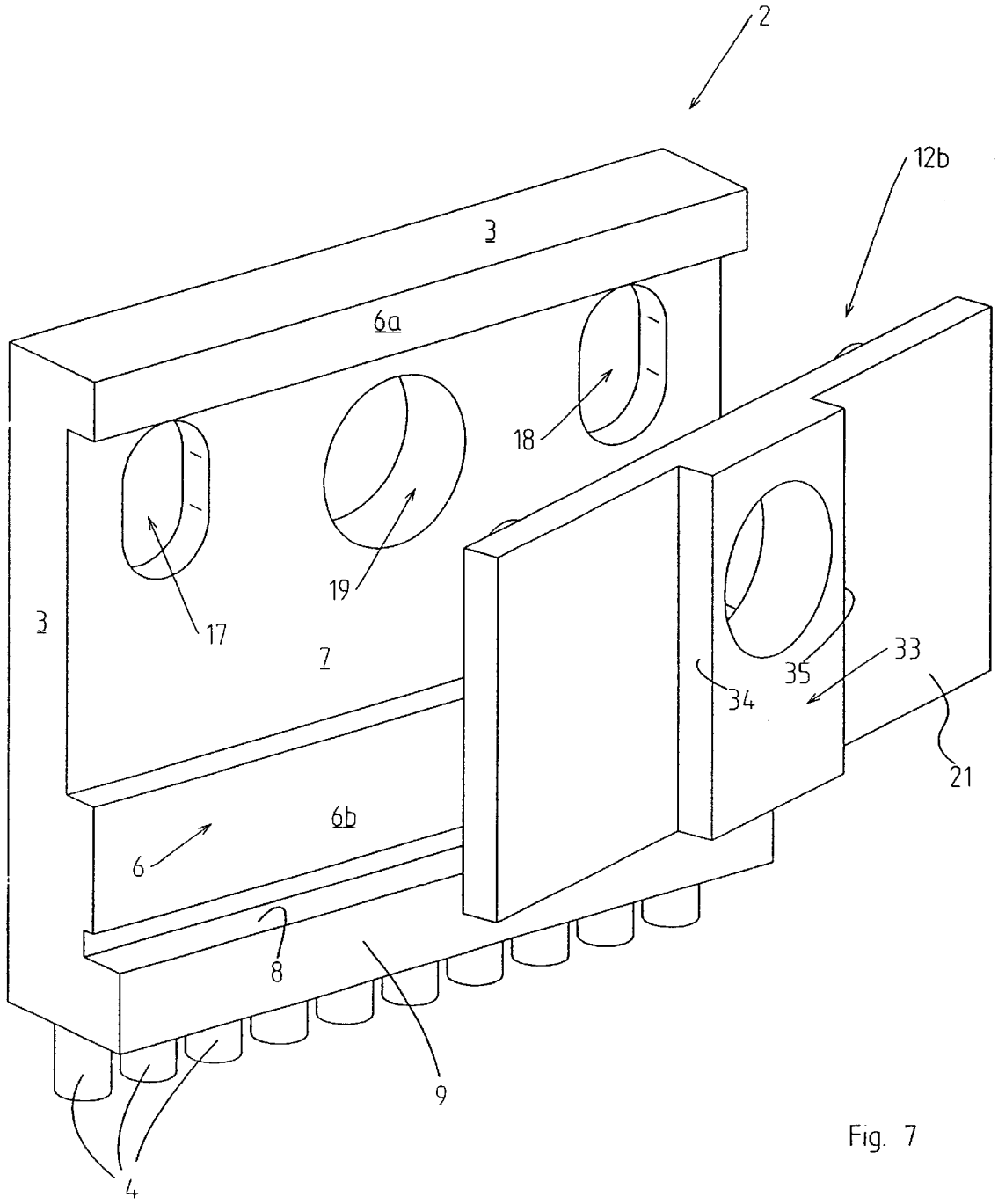
FIG. 7 is an enlarged exploded perspective view of a standard module with adapter shown in FIG. 2.
Figure 8:
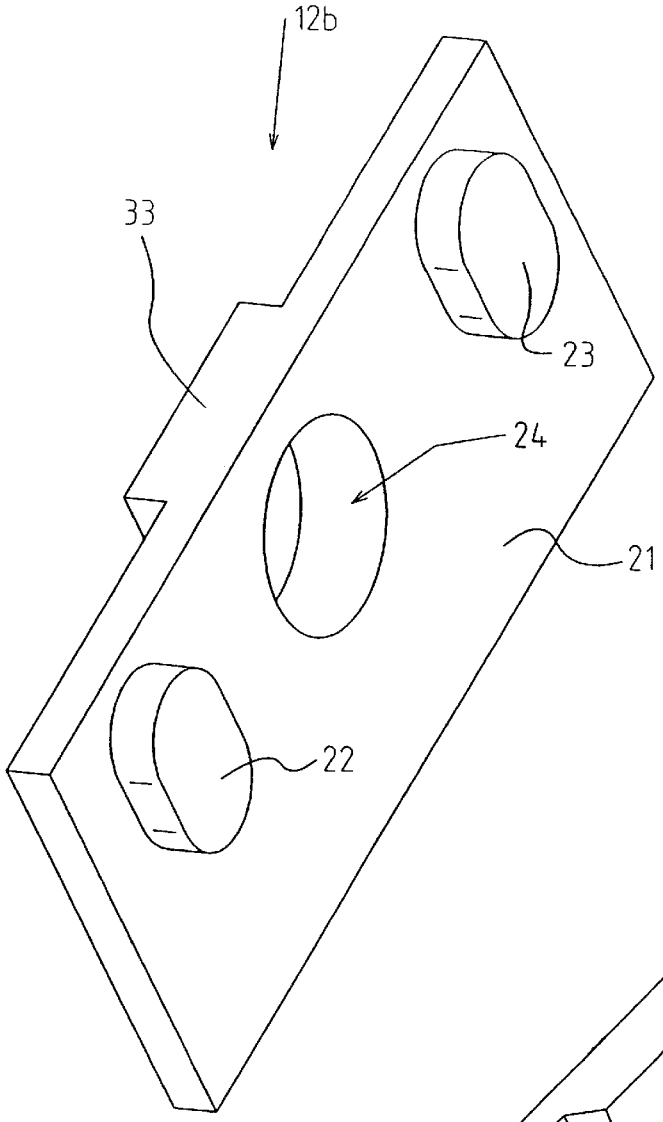
FIGS. 8 and 9 are perspective views, as seen from opposite sides, of the adapter shown in FIG. 7.
Figure 9:
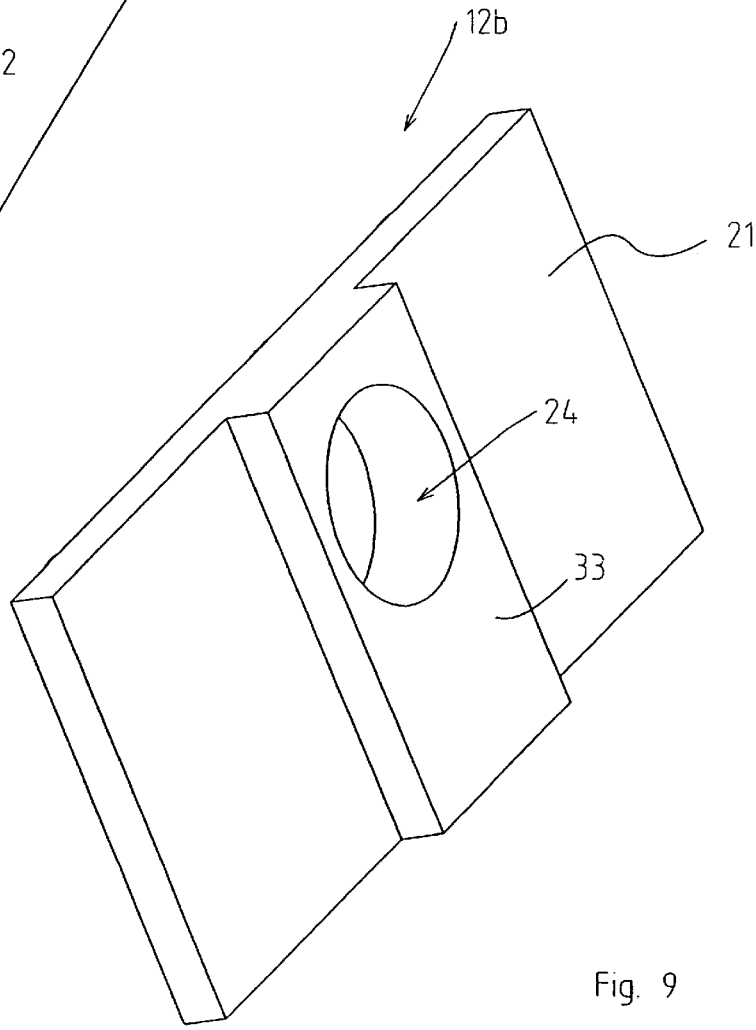

FIG. 2 illustrates a modified carrier bar 1' which holds standard modules 2 using modified adapters 12*b*. The carrier bar 1' has positioning grooves 31 which are formed in the contact face 29 and which extend transversely to the length dimension of the carrier bar 1'. An internally threaded securing opening 30 is provided in the bottom of each positioning groove 31. The positioning grooves 31 are bounded by parallel-extending flanks. The corresponding adapter 12*b* is illustrated in FIGS. 7, 8 and 9. The face of the adapter 12*b* oriented towards the module is configured identically to that of the adapters shown in FIGS. 4, 5, 6 or FIGS. 10, 11, 12. As concerns these components of FIG. 2, reference is made to the preceding description of the previously presented embodiments. The side of the adapter 12*b* oriented towards the carrier bar 1' is structured differently from that of adapters 12 and 12*a*: From the face of the rectangular plate portion 21 a positioning rib or web 33 projects, whose shape corresponds to the shape of the positioning groove 31 of the carrier bar 1'. In particular, the distance between the flanks 34, 35 of the web 33 is identical to the distance between the flanks of the positioning groove 31 so that the adapter 12*b* may be seated on the carrier bar 1' with a small clearance or with no clearance at all. The height of the positioning web 33 may be slightly less than the depth of the positioning groove 31 in order to ensure that the force-transmitting engagement between the base body 3 and the carrier bar 1 is limited to the surface portions 6*a*, 6*b* of the contact face 6 and also possibly to that face of the portion 21 of the adapter 12*b* which is oriented toward the carrier bar 1'.

Figure 3:
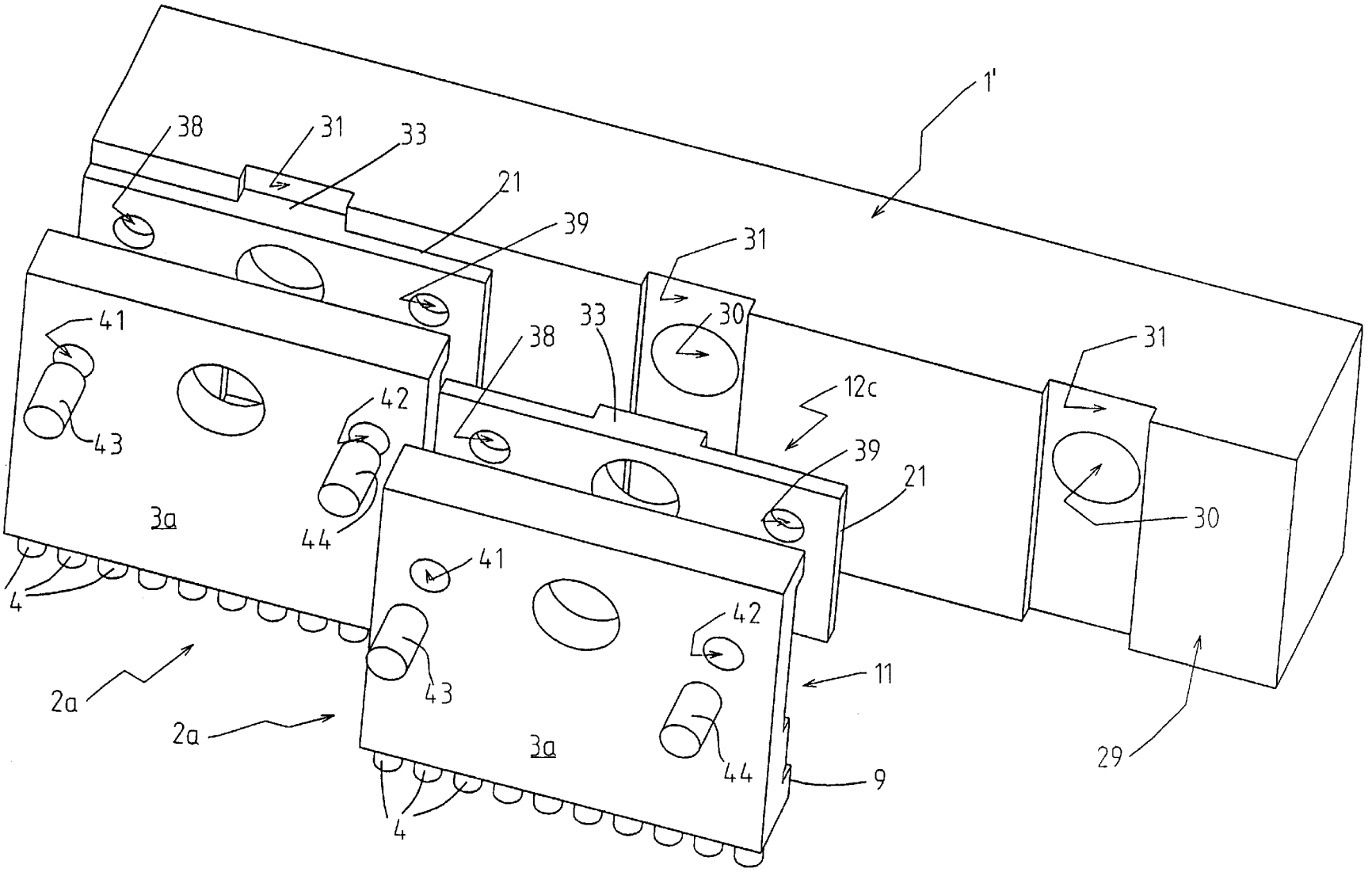

Based on the embodiment shown in FIG. 2, a further variant shown in FIG. 3 may be developed. In the FIG. 3 embodiment, a modified adapter 12*c* and, for the module 2*a*, additionally a modified base body 3*a* are provided. The embodiment of FIG. 3 is configured in accordance with that of FIG. 2, except that the adapter 12*c* has no projections 22, 23 for securement in the mounting 11. Instead, the plate-shaped portion 21 of the adapter 12*c* is provided with openings 38, 39 which, similarly to the projections 22, 23, are asymmetrically arranged with respect to an axis passing perpendicularly through the middle of the plate-shaped portion 21. Such an arrangement ensures an unequivocal inserting orientation of the adapter into the mounting 11.

For connecting the adapter 12*c* to the base body 3*a*, in the latter, openings 41 and 42 are provided which have approximately the same diameter as that of openings 38 and 39 provided in the adapter 12*c*. The opening 41 is in alignment with the opening 38 and the opening 42 is in alignment with the opening 39. Positioning pins 43, 44 fit into the aligned openings 38, 41 and, respectively, 39, 42 for attaching the adapter 12*c* with a respective module 2*a*.

Further, non-illustrated carrier bar/module/adapter combinations are feasible in which the carrier bar has additional openings, preferably blind bores, which are in alignment with the openings 41, 42 of the module and with the openings 38, 39 of the adapter. By means of pins 43, 44 which have a greater length, the adapter may be coupled with the module and the carrier bar.

Figure 13:
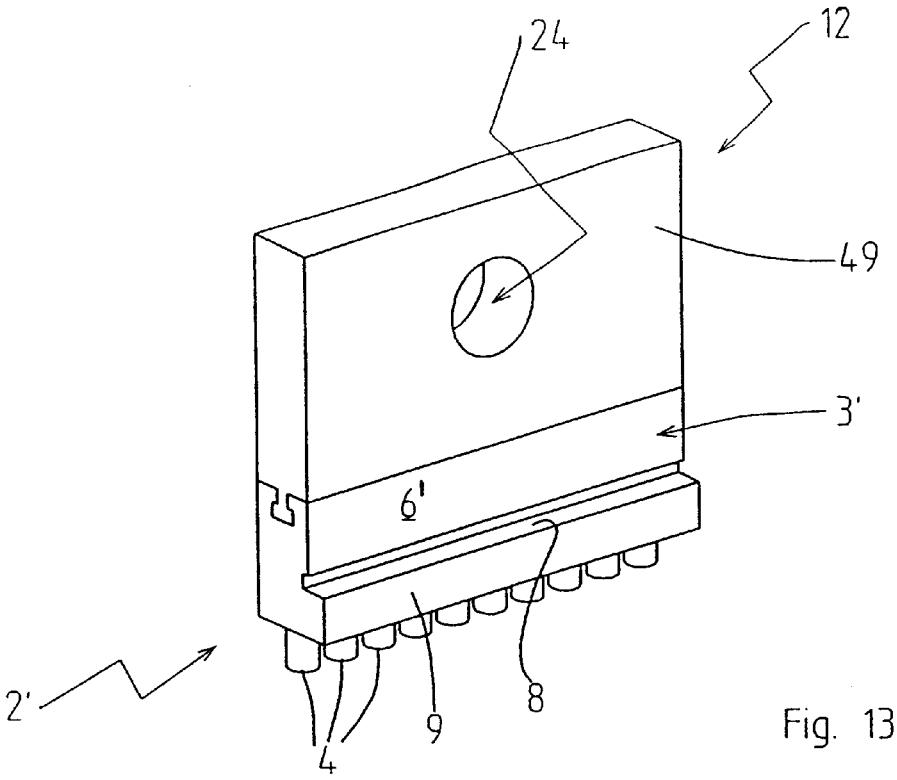
FIGS. 13 and 14 are perspective illustrations of a further embodiment of the module with adapter for a carrier bar having a planar contact face, showing different relative positions of the adapter and the module.
Figure 14:
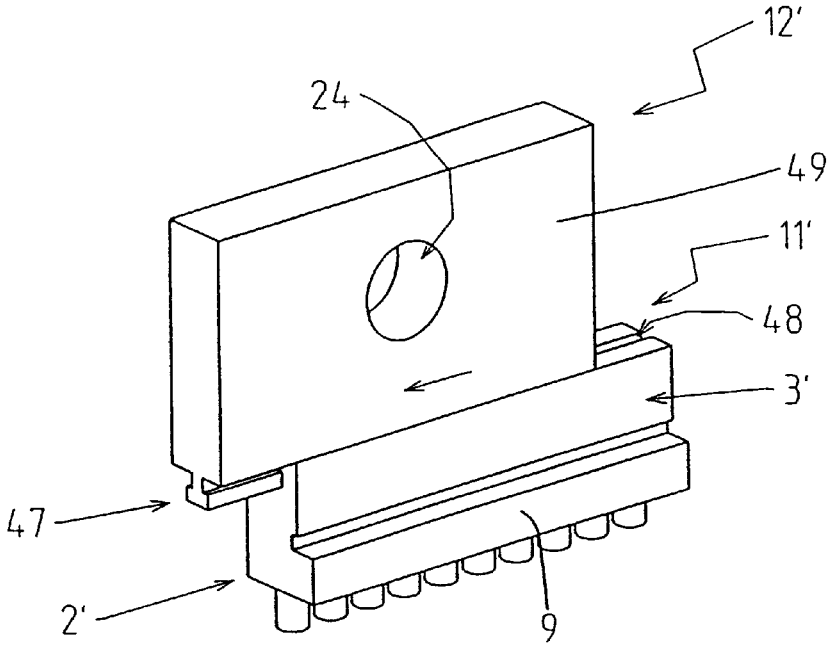

In FIGS. 13 and 14 a modified standard module 2' is shown, whose base body 3' is significantly shortened with respect to the vertical directions defined by the shanks 4. The contact face 6' is accordingly reduced to a narrow strip. The force-transmitting surface 8 remains unchanged.

At its side oriented away from the needles 4, the base body 3' has a mounting 11' which is formed as a linear guide and to which an adapter 12' may be attached. The adapter is generally rectangular and has at its long, narrow side oriented towards the base body 3', a rib 47' of T-shaped cross-sectional configuration. The base body 31, in turn, has a T-shaped groove 48 (mounting) which extends through the base body 3' along its narrow side oriented towards the adapter 12'. The T-shaped rib 47 may be received in the T-shaped groove 48, and the adapter 12' may be slid off the base body 3' as it may be observed in FIGS. 13 and 14.

The adapter 121 is entirely flat at its side oriented towards the carrier bar 1 and thus has a planar contact face 49 which is traversed only by the opening 24. The contact face 49 is flush with the contact face 6 of the base body 3'. By virtue of such an arrangement the adapter 12' forms a standard adapter for the carrier bars which have non-profiled contact faces.

Figure 15:
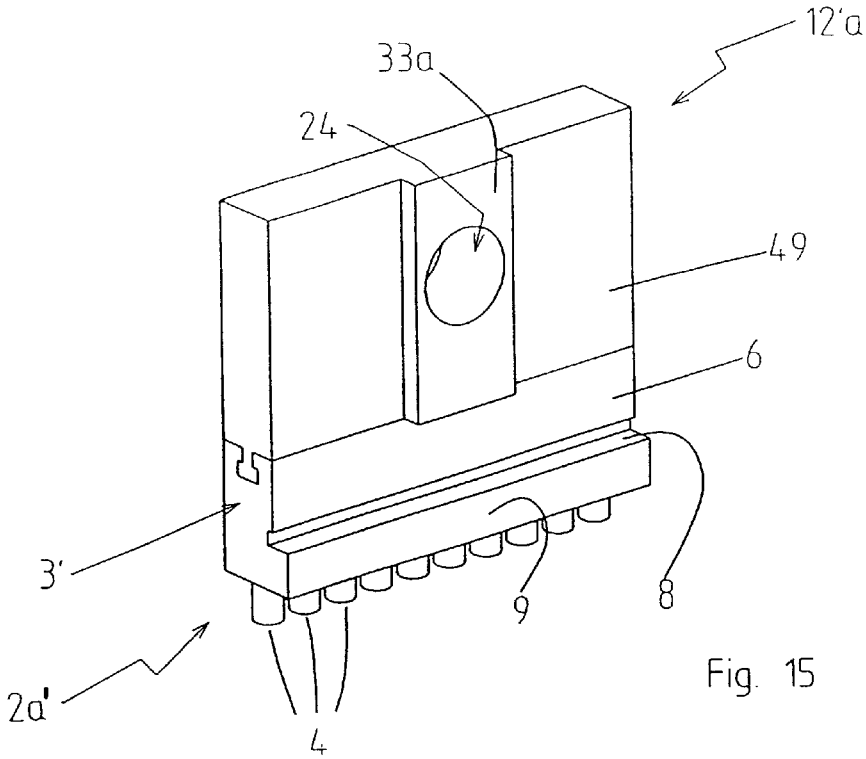
FIGS. 15 and 16 are perspective views of a further embodiment of a module and an adapter for a carrier bar having vertical openings, showing different relative positions of the adapter and the module.
Figure 16:
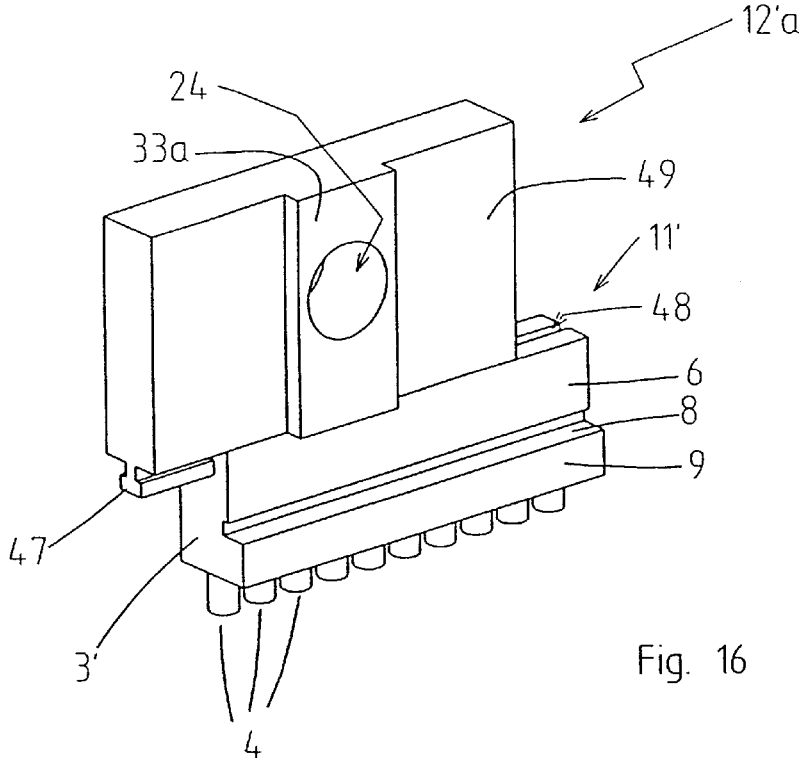

FIGS. 15 and 16 show the module 2*a'* in conjunction with a further modified adapter 12'*a* which, except for a positioning rib 33*a* projecting from the contact face 49, fully corresponds to the construction of the adapter 12' shown in FIGS. 13 and 14. The rib 33*a* corresponds essentially to the positioning web 33 of the adapter 12*b* according to FIGS. 2, 7, 8 or 9 and is provided for securing the module 2*a'* to the carrier bar 1' in accordance with FIG. 2.

Figure 17:
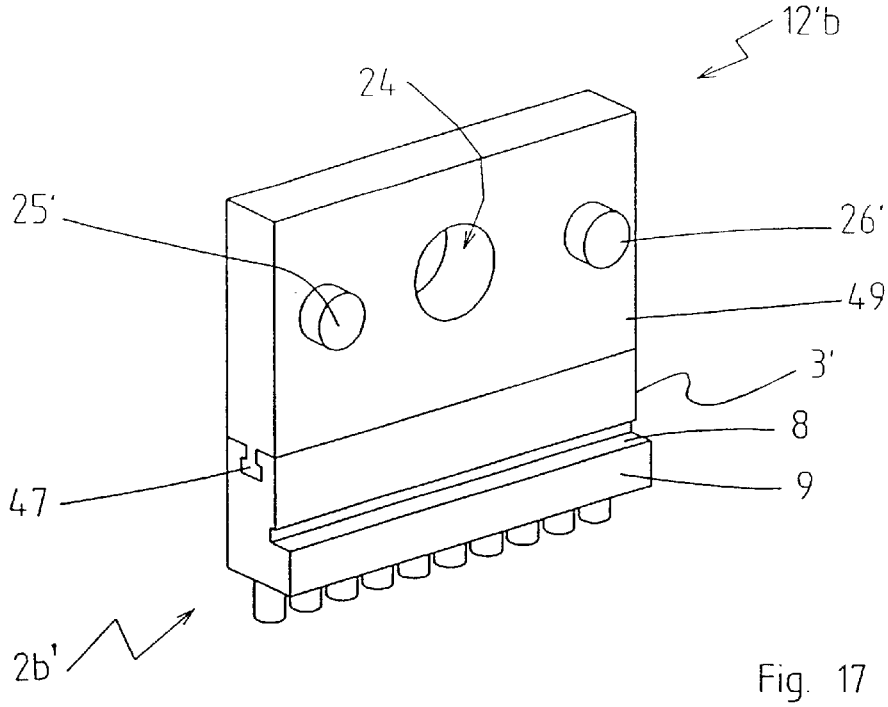
FIGS. 17 and 18 are perspective views of a module and an adapter for a carrier bar according to FIG. 1, showing different relative positions of the adapter and the module.
Figure 18:
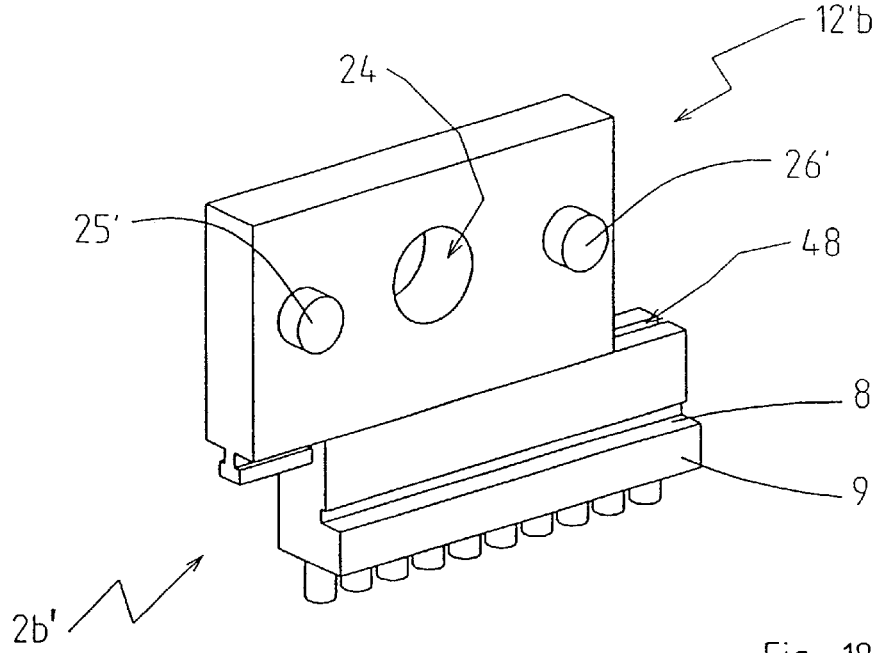

FIGS. 17 and 18 show a module 2*b'* having a further modified adapter 12'*b*. The adapter 12'*b* differs from the adapter 12' according to FIGS. 13 and 14 by its two pin-like projections 25', 26' which rise from the planar surface 49 and which correspond approximately to the pins or projections 25, 26 of the adapter 12 shown in FIG. 6. The adapter 12'*b* is to be coupled with a carrier bar 1 according to FIG. 1 which has orienting openings 27, 28.

In case the rib 47 and the T-shaped groove 48 are arranged centrally on the adapter 12' or the base body 3' and are otherwise symmetrically constructed, the adapter 12' (according to FIGS. 13–18) may be secured to the base body 3' in two different positions. In a first position the contact face 49 is oriented towards the carrier bar 1 while in a second position the contact face 49 is situated at the opposite side and is thus oriented away from the carrier bar 1. The adapter 12' therefore may be, as required, provided on either flat sides with different profiles to serve as an adapter for two different carrier bar systems.

It is also feasible to form the rib 47 and the form-fitting mounting 48 on the module 2' in an asymmetric manner. Such an arrangement prevents a 180° reversed insertion of the tools into the machine.

Further non-illustrated embodiments may be provided in which the cross section of the rib 47 has a shape different from a dovetail. In such a case the mounting 48 of the module 2' is form-fittingly configured.

Figure 19:
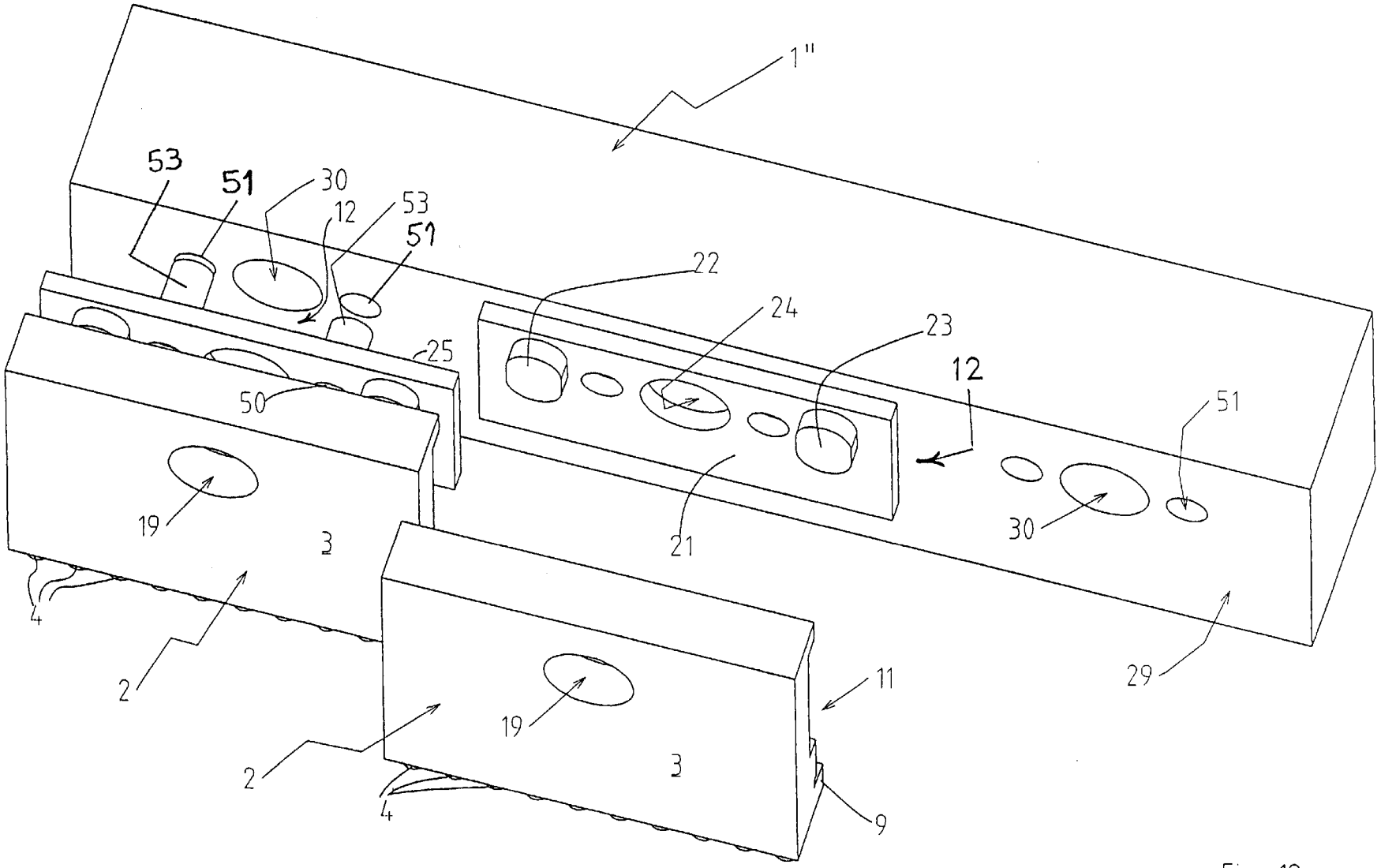
FIG. 19 is an exploded perspective view of a further embodiment of a carrier bar, a module and an adapter.

FIG. 19 illustrates a further embodiment of the carrier bar 1" illustrated with modules 2 and adapters 12. The adapter 12 is of planar configuration on its side oriented towards the contact faces 29 of the carrier bar 1". For orienting the adapter 12 with respect to the carrier bar 1", in the adapter 12 openings 50 are provided which are in alignment with openings 51 of the carrier bar and serve as orienting openings. The diameters of the openings 50, 51 are substantially identical to one another. The openings 51 are provided, for example, on both sides of the securing opening 30. Accordingly, the openings 50 in the adapter 12 are arranged on either side of the opening 24 and are together flanked by the projections 22 and 23. As shown in FIG. 19, pairs of aligned openings 50, 51 may each receive positioning elements such as pins 53 which immobilize the adapter in the carrier bar 1".

On its side oriented away from the carrier bar 1", the adapter 12 of FIG. 19, similarly to the embodiment shown in FIG. 1, is provided with projections 22, 23. The module 2 and particularly the base body 3 are identical to the FIG. 1 embodiment. The adapter 12 is secured to the carrier bar 1" by a pin connection, so that the base body 3 of the module 2 may be mounted in a correct position on the carrier bar 1" and may be affixed thereto by means of a securing screw. The base body 3 embraces the adapter 12 and directly engages the contact face 29 of the carrier bar 1".

It will be understood that the above description of the present invention is susceptible to various modifications, changes and adaptations, and the same are intended to be comprehended within the meaning and range of equivalents of the appended claims.

What is claimed is:

1. An assembly for a textile machine, comprising (a) a carrier bar for attachment to the textile machine;

(b) a plurality of module base bodies lined up in a series along said carrier bar; each said module base body carrying a plurality of tools and each having a mounting; and (c) a plurality of separate adapters lined up in a series along said carrier bar; said separate adapters being components separately attached to and separately removable from said carrier bar; respective said separate adapters being received in said mounting of respective said module base bodies; each said adapter including holding and orienting means for holding the respective module base body and for orienting the respective module base body relative to said carrier bar independently from an adjoining said module base body, whereby each said adapter can match variously configured module base bodies to variously configured carrier bars.

2. The assembly as defined in claim 1, wherein at least one of the mountings and a respective said adapter are in one of frictional and form-locking engagement with one another.

3. The assembly as defined in claim 1, wherein at least one of said module base bodies has parts which embrace a respective said adapter.

4. The assembly as defined in claim 1, wherein at least one of said holding and orienting means includes asymmetric means for allowing a positioning of a respective said adapter on and relative to a respective said module base body in a sole orientation.

5. The assembly as defined in claim 1, wherein at least one of said mountings is a receiving pocket into which a respective said adapter is insertable.

6. The assembly as defined in claims 5, further comprising one of openings and projections provided in said receiving pocket for positioning and holding said respective adapter on said one module base body.

7. The assembly as defined in claim 1, wherein at least one of said module base bodies includes a contact face interrupted by a receiving pocket; said receiving pocket constituting said mounting.

8. The assembly as defined in claim 7, wherein said contact face has contact face portions externally of said receiving pocket; further wherein a respective said adapter is flanked by said contact face portions when said respective adapter is seated on said one module base body.

9. The assembly as defined in claim 1, further comprising a securing opening provided in at least one of said module base bodies.

10. The assembly as defined in claim 9, wherein said securing opening is situated in said mounting of said one module base body.

11. The assembly as defined in claim 1, wherein said holding and orienting means of at least one of said adapters comprises first orienting means for correctly positioning said one adapter with respect to a respective said module base body and second orienting means for correctly positioning said one adapter with respect to said carrier bar.

12. The assembly as defined in claim 11, wherein said second orienting means comprises (a) at least one first opening provided in said one adapter;

(b) at least one second opening provided in said carrier bar and being in alignment with said first opening; said first and second openings forming an opening pair; and (c) a positioning member insertable into said opening pair.

13. The assembly as defined in claim 11, wherein said first orienting means comprises (a) at least one first opening provided in said one adapter;

(b) at least one second opening provided in said respective module base body and being in alignment with said first opening; said first and second openings forming an opening pair; and (c) a positioning member insertable into said opening pair.

14. The assembly as defined in claim 13, wherein said positioning member is a pin.

15. The assembly as defined in claim 13, wherein said one adapter has a thickness and further wherein said positioning member has a length greater than said thickness, and in an inserted state said positioning member is in engagement with said respective module base body, said one adapter and said carrier bar.

16. The assembly as defined in claim 1, wherein at least one of said adapters includes means for transmitting forces between said carrier bar and a respective said module base body.

17. The assembly as defined in claim 16, further comprising an opening provided in said one adapter for establishing a connection between said one adapter and said carrier bar.

18. The assembly as defined in claim 17, further comprising form-locking means for attaching said one adapter to said respective module base body.

19. The assembly as defined in claim 18, wherein said form-locking means comprises a first component forming part of said respective module base body and a second component forming part of said one adapter; one of said first and second components comprises an undercut groove and the other of said first and second components comprises a rib received in said groove.

20. An assembly and kit for a textile machine, comprising (a) a carrier bar for attachment to the textile machine;

(b) a module base body carrying a plurality of tools and having means for defining a mounting; and (c) a kit of adapters each being selectively receivable in said mounting and each including holding and orienting means for holding said module base body and for orienting said module base body relative to said carrier bar; whereby each adapter of the adapter kit is specifically configured to fit variously configured carrier bars.

21. An assembly for a textile machine, comprising a carrier bar for attachment to the textile machine; a module base body carrying a plurality of tools and having a mounting; and an adapter received in said mounting and including holding and orienting means for holding said module base body and for orienting said module base body relative to said carrier bar, whereby said adapter can match variously configured module base bodies to variously configured carrier bars; said module base body having parts passing through said adapter.

* * * * *